US005539989A

United States Patent [19]

Potter

[11] Patent Number: 5,539,989

[45] Date of Patent: Jul. 30, 1996

[54] RANGE COMPENSATION BOW SIGHT

[76] Inventor: Jack E. Potter, 1601 Bruin St., Ruston, La. 71270

[21] Appl. No.: 371,559

[22] Filed: Jan. 9, 1995

[51] Int. Cl.[6] ..... F41G 1/01

[52] U.S. Cl. ..... 33/265; 124/87

[58] Field of Search ..... 33/233, 237, 263, 33/265, 252, 254, 391, 398, 400; 124/87, 88

[56] References Cited

U.S. PATENT DOCUMENTS

| | | | |
|---|---|---|---|
| 2,825,137 | 3/1958 | Meetin | 33/252 |
| 3,013,336 | 12/1961 | Pennington | 33/265 |
| 3,058,221 | 10/1962 | McNeel | 33/265 |
| 3,618,586 | 11/1971 | Current et al. | 124/87 |
| 4,120,096 | 10/1978 | Keller | 33/265 |
| 4,417,403 | 11/1983 | Strange | 124/87 |
| 5,305,530 | 4/1994 | Robertson, Jr. et al. | 33/265 |

*Primary Examiner*—William A. Cuchlinski, Jr.
*Assistant Examiner*—G. Bradley Bennett
*Attorney, Agent, or Firm*—John M. Harrison

[57] ABSTRACT

This invention pertains to an an archery bow sight and more particularly to a bow sight that automatically compensates for arrow trajectories of various target ranges and elevations when an arrow is shot from a position elevated above ground level. The sight can be manually adjusted to compensate for arrow trajectories of various ranges when an arrow is shot from ground level. In a preferred embodiment the bow sight is designed as one unit or assembly mounted directly to the bow with an adjustable bracket. The bow sight assembly has a fixed front sight and a rear sight which moves vertically to compensate for arrow trajectories of various ranges and angles. The rear sight is raised or lowered by a profiled cam positioned by a pivoting weight.

21 Claims, 2 Drawing Sheets

RANGE COMPENSATION BOW SIGHT

BACKGROUND OF THE INVENTION

1. Field of the Invention

This invention relates in general to archery bow sights and in particular to a tree stand bow sight that automatically adjusts the sight to compensate for varying target ranges when shooting from a position elevated with respect to ground level.

2. Description of Related Art

Shooting an arrow accurately from a traditional or a compound bow at a a target either alive or inanimate requires a relatively precision sighting device. The archer must judge range and shot angle when shooting from an elevated position and adjust for the trajectory of the arrow under these conditions. Compounding the sighting problem for the game hunting archer is the need to sometimes shoot very quickly in low light conditions and in possibly inclimate weather. The bow hunter must sometimes traverse rugged landscape, often in the dark, or climb into stands or trees, necessitating that a sighting device be simple, light, and able to endure the rigors of daily rough use. Sometimes the bow hunter does not have time for precision sight alignment and must quickly and instinctively shoot an arrow while subconsciously using some portion of the bow, arrow, or sight as a point of reference. There are many bow designs that have been developed as attempts to solve these problems. A majority of these sights use a string-mounted peep sight for the rear sight. These sights are accurate, but have the serious disadvantage of loss of light that occurs when sighting through a small aperture. The most common front sight is the pin-type which requires that the archer judge the range of the target and, if shooting from a position elevated above ground level, such as a tree stand, compensate for change in arrow trajectory due to shooting downward at various angles. There are several pendulum-type sights available commercially that solve this problem to various extents. These sights basically change the height of the front sight by attaching the front sight directly to a swinging weight. These sights require the use of a string-mounted peep sight that have the disadvantages previously mentioned (example: Keller Bow Sight, U.S. Pat. No. 4,120,096). Many of these types of sights are delicate and can be easily damaged in the field.

SUMMARY OF THE INVENTION

This invention is a new and improved bow sight that will automatically adjust for target range when shooting from a position elevated above with respect to ground level and further accomplish the above without sighting through light-limiting rear aperture sights, clear, light-transmissive materials or other methods that limit the vision of the target. The invention is different from previous bow sights in that the rear sight is automatically raised or lowered to the appropriate degree to compensate for arrow trajectory by a uniquely profiled cam. The cam is automatically positioned by a weight attached to the cam in such a manner as to form a pivoting assembly that will raise or lower the rear sight. The preferred embodiment of this sight includes a sight body mounted on the bow with a bow mounting bracket. The sight body houses and supports an open, fixed front sight, a vertically-pivoting rear sight, a cam profiled to position the appropriate elevation of the rear sight, and a cam-positioning weight attached to and powering cam movement. The cam/cam positioning weight assembly is enclosed within the sight body, and the configuration of the assembly allows design and construction of a compact, rugged, and trouble-free sight that will accurately compensate for arrow trajectory. Use of a uniquely profiled cam to raise or lower a pivoting rear sight carrier and an attached rear sight facilitates a sight that will accommodate any bow or arrow combination. The cam profile is obtained empirically by actually shooting with specific bow/arrow combinations from a constant height and at different ranges. The rear sight elevation is measured for each range, and these measurements are used to design the cam profile. A preferred embodiment of this sight configuration resembles that of a hand-held firearm (pistol) and allows both instinctive and precision aiming familiar to most firearm users. This embodiment also allows an archer to calibrate the sight for his individual bow and arrow combination when shooting from a non-elevated position. This can be accomplished by shooting at various ranges and marking each range on a graduated scale at a position indicated by a cam positioning weight pointer as each arrow impacts.

The invention will be better understood by reference to the accompanying drawings, wherein.

DESCRIPTION OF THE PREFERRED EMBODIMENTS

Figure 1:
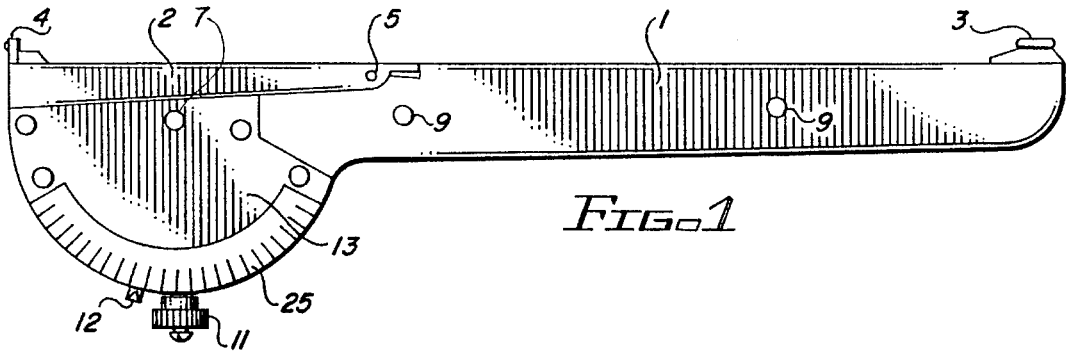
FIG. 1 is a side elevation of a preferred embodiment of the range compensating bow sight of the present invention.
Figure 2:
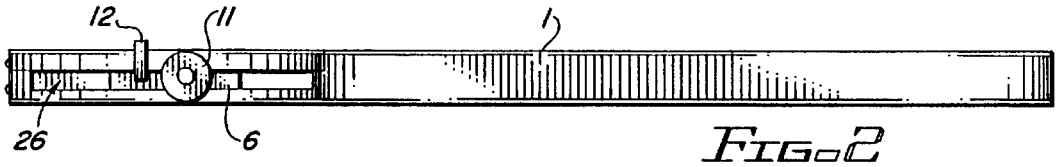
FIG. 2 is a bottom view of the device illustrated in FIG. 1.

Referring initially to FIG. 1 of the drawings, in a preferred embodiment the sight body of the bow sight of this invention is generally illustrated by reference numeral 1. The sight body 1 houses and supports the main components of the invention. Preferably, the sight body 1 is constructed of a plastic material that can be formed accurately and economically into a compact, light, rugged and corrosion-resistant unit. The preferred configuration of the sight body 1 was chosen for the following reasons: (1) it would enclose the moving parts of the cam 8 and the cam positioning weight 6, thus protecting them from weather and damage; and (2) the basic shape of the sight body 1 resembles that of a hand-held firearm (pistol) familiar to most sportsmen and thus provides an accurate sight plane for both precision and instinctive sighting.

Figure 3:
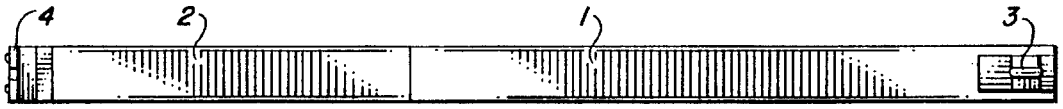
FIG. 3 is a top view of the device illustrated in FIG. 1.
Figure 4:
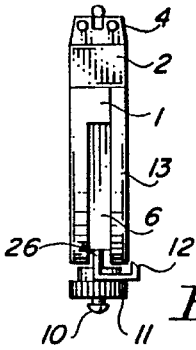
FIG. 4 is a rear view of the device illustrated in FIG. 1.
Figure 5:
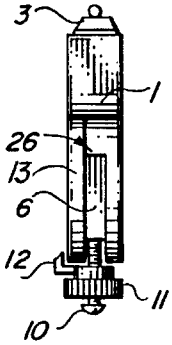
FIG. 5 is a front view of the device illustrated in FIG. 1.

Referring now to FIGS. 1, 3 and 5 of the drawings, a front sight 3 is a single-point fixed sight that can be constructed of a light-gathering or light-emitting material in such a fashion that it can be easily seen in low light conditions.

Figure 6:
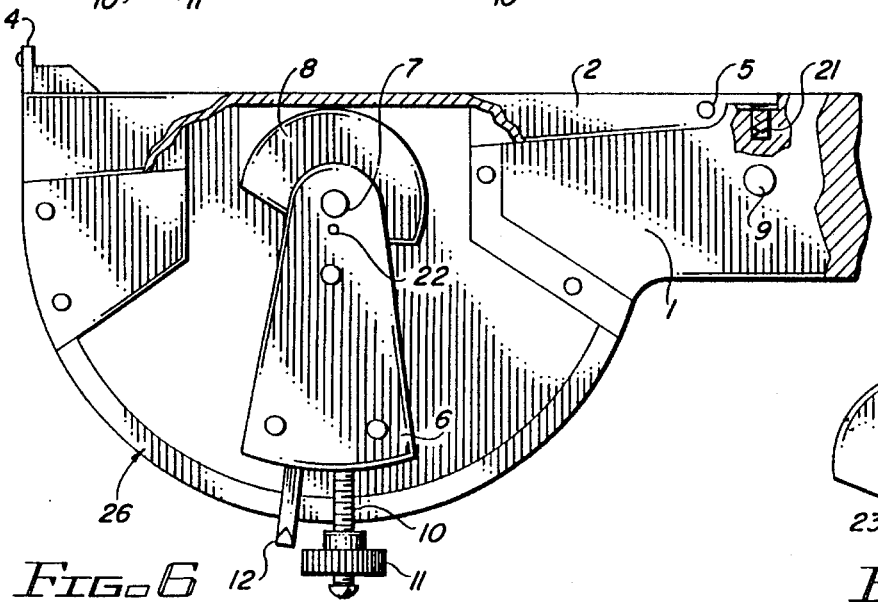
FIG. 6 is an enlarged fragmentary side elevation of the device illustrated in FIG. 1, with the access cover removed.
Figure 7:
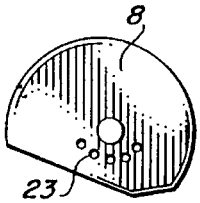
FIG. 7 is a side elevation of the sight cam element of the device.
Figure 8:
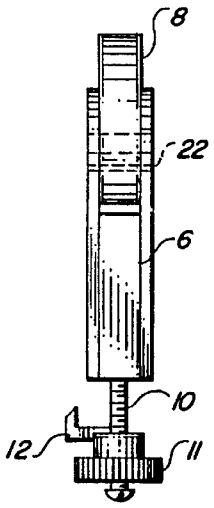
FIG. 8 is an end elevation of the cam/cam positioning weight assembly.

Referring next to FIGS. 1, 3, 4 and 6 a rear sight carrier 2 is preferably constructed of plastic similar to the sight body 1 and in this embodiments pivoted at the forward end thereof by a rear sight carrier pivot 5. The rear sight carrier pivot 5 is constructed in such a manner as to provide low rotational friction and allow raising and lowering of the rear sight carrier 2 and the rear sight 4 with a minimum of lateral movement. The rear sight carrier 2 rests on the profiled surface of the cam 8 as shown in FIG. 6 and translates cam profile displacement into vertical movement of the rear sight carrier 2 and rear sight 4.

Referring to FIGS. 1, 3, 4, 5 and 6 the rear sight 4 is rigidly attached to the rear of the rear sight carrier 2 and has a rectangular notch in the center top edge thereof having approximately the same dimensions as those of the front sight 3 thus providing accurate front-to-rear sighting. In a preferred embodiment two small (1/16" dia.) dots of light-gathering or light-emitting material are located adjacently on either side of the notch and have a contrasting color with respect to the front sight 3. The rear sight 4, rear sight carrier 2, sight body 1, and front sight 3 provide a continuous sighting plane for both precision and instinctive sighting.

Referring next to FIG. 6, and noting the relationship of the following parts: cam 8, cam positioning weight 6 and cam positioning weight pivot 7, in this embodiment the cam 8 is pivotally mounted in the sight body 1 adjacent to the rear sight carrier 2 by means of the cam positioning weight pivot 7, and raises or lowers the rear sight carrier 2. Accordingly, the rear sight 4 is raised or lowered when adjusted because of the cam profile, as hereinafter further described. This angular movement is powered by the cam positioning weight 6. The cam 8 profile can be designed for specific bow/arrow combinations empirically, that is by trial and error, and is discussed later in this section. The cam positioning weight 6 is positioned in the sight body 1 and attached to the cam 8 by means of the cam positioning weight pivot 7 and the cam weight indexing pin 22. The cam positioning weight 6 and the cam 8 operate as a unit and swing freely on the cam positioning pivot 7. The cam positioning weight pivot 7 is constructed in such a manner as to provide low rotational friction and minimal lateral movement in order for the cam 8 and cam positioning weight 6 to move freely in the sight body 1 and access the cover 13 without touching the sides thereof. The cam 8 can be constructed of plastic, preferably one with a low coefficient of friction so that the cam 8 will operate smoothly relative to the rear sight carrier 2. In this preferred embodiment of the invention the cam positioning weight 6 is constructed in a sandwich type construction having a first aluminum sheet, a lead core, and a second aluminum sheet. The aluminum sheets' strength is needed to support the heavy lead core on the cam positioning weight pivot 7. The heavy lead core is needed to provide the forces necessary to lift and lower the rear sight carrier 2 and the rear sight 4 smoothly. Referring again to FIG. 1 the removable access cover 13 in this embodiment is constructed in such a manner as to provide a removable cover to access the interior of the sight body 1. Referring again to FIGS. 1 and 6, it will be noted that the lower rear portions of the straight body 1 and the matching access cover 13 have a circular configuration. The radius of this portion of the sight body 1 uses the cam positioning weight pivot 7 as a center so that clearances of the cam positioning weight 6 within the sight body 1 are uniform. The access cover 13 can be constructed of a plastic material similar to that of the sight body 1. Referring again to FIG. 6 of this embodiment a rear sight carrier return spring 21, mounted in the sight body 1, abuts the rear sight carrier 2 and provides positive downward return of the rear sight carrier 2. Referring again to FIG. 6, and noting the relationship between the threaded stud 10 and locking thumb nut 11, the threaded stud 10 is connected in a rigid fashion to the bottom of the cam positioning weight 6 and extends downwardly therefrom, through an elongated slot 26 provided in the bottom of the sight body 1. The locking thumb nut 11 is threaded on the threaded stud 10, for locking the cam positioning weight 6 in any desired position along the range of angular travel thereof, by threading the locking thumb nut 11 on the threaded stud 10, against the bottom of the sight body 1. A cam positioning weight pointer 12 likewise extends from the bottom of the cam positioning weight 6 through the slot 26 and indicates the position of the cam positioning weight 6. The slot 26 provides clearance for movement of the thumb locking nut 11 and the cam positioning pointer 12 as the cam positioning weight 6 moves through the range of motion thereof. Uses of the thumb locking nut 11 and the range indicator 12 will be discussed later in this section.

Figure 9:
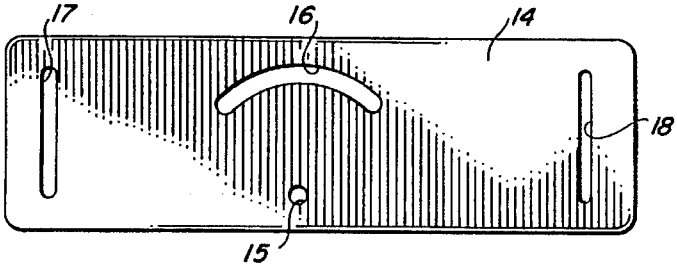
FIG. 9 is a side elevation of the sight mounting bracket.
Figure 10:
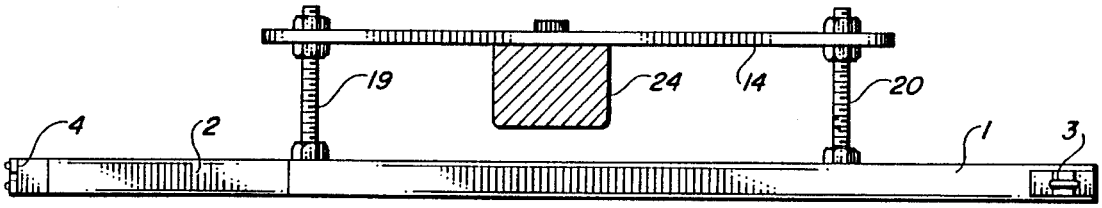
FIG. 10 is a sectional plan view of the device illustrated in FIG. 1 mounted to a bow.

Referring now to FIG. 9 of the drawings a sight mounting bracket 14 can be constructed of sheet aluminum and can be fastened to the bow with allen head cap screws using a mounting hole 15 and mounting slot 16 and threaded holes standard in most bows. The mounting slot 16 allows horizontal angular adjustment of the bow sight assembly. Slots 17 and 18 are used for vertical adjustments of the assembled sight. Referring next to FIG. 10 of the drawings, sight-to-bracket mounting studs 19 and 20 mount to the sight body 1 with threaded holes and lock nuts and to the sight mounting bracket 11 through slots 17 and 18 and are retained with locking nuts, to provide horizontal adjustment of the assembled bow sight shown in FIG. 1.

Figure 11:
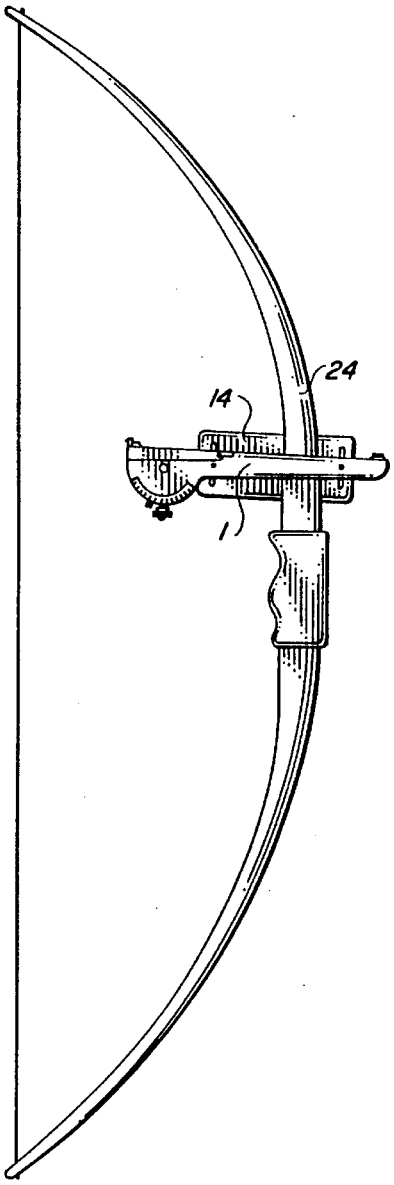
FIG. 11 is a side elevation of the range compensating bow sight mounted on a bow.

In the preferred embodiment of this invention, the profiled area of the cam 8 that is in contact with the rear sight carrier 2 throughout a range of angular movement thereof can be developed empirically by trial and error. Starting with one specific bow/arrow combination, the assembled sight is mounted on the bow as indicated in FIG. 11. At this point the assembled sight contains all parts previously described except that the cam 8 and cam positioning weight 6 are not installed. A method was fashioned that allows the rear sight carrier 2 to be locked in place at any position along its range of vertical movement. Initial sighting in of the bow and the assembled sight is accomplished by locking the rear sight carrier 2 in place in the lowest position, firing arrows at a target at a range of 10 feet and using the adjustments previously described, until the arrows impacted on the target.

Arrows were then shot at a target from a height of 20 feet. This height was chosen because it is a popular height at which to place stands when hunting deer and other big game. Arrows were fired straight down in order to establish a base with the rear sight carrier 2 at its low position (down against the sight body 1) and refine the arrow impact point. Arrows were fired at increasing ranges in increments of 3 yards. The rear sight carrier 2 was adjusted upwardly and locked in place when arrows were accurately impacting the target at each range. The vertical displacement of the rear sight carrier 2 was carefully measured at each range and recorded. The shot angle in degrees from vertical was calculated for each range. For example, at a range of 15 feet when shooting from a 20 foot height, the calculated angle from vertical is approximately 32 degrees. These calculated angles were used to determine the degree of rotation of the cam 8 from a zero base point for each vertical displacement increase. This process was continued up to a range of 105 feet to develop the profile of the cam 8. It was found that for ranges of 0 to 15 feet, arrow trajectory was negligible and there was little practical use for the cam 8/cam positioning weight 6 to operate at this steep angle. The cam 8 profile beyond an angle of 77 degrees, which corresponds to a 35 yard range, was established by arbitrarily establishing a uniform increase in rear sight height for a uniform angular rotation of the cam 8. This part of the profile of the cam 8 is used for ground level shooting at longer ranges.

The cam 8 and cam positioning weight 6 were assembled and indexed with the indexing pin 22 in such a fashion that when the bow sight assembly is aimed downward from the horizontal at any angle between 0 degrees and 77 degrees, the sight 4 automatically moves to the appropriate position to compensate for arrow trajectory. When shooting from an elevated position of approximately 20 feet, the locking thumb nut 11 is loosened, allowing the cam 8/cam positioning weight 6 assembly to swing free. When shooting from ground level, the sight can be calibrated for various ranges by manually moving and locking the rear sight 4 into position with the locking thumb nut 11 at the correct position for the arrow to hit the target. Using the cam positioning weight pointer 12 as a reference, the appropriate range can be written on the graduated scale 25. Once the ranges are marked on the graduated scale 25 the archer can shoot at any reasonable range by estimating the distance to the target and manually setting the weight pointer 12 at the appropriate range mark.

The parts and configuration of the range compensating bow sight of this invention operate together to form a unique bow sight that eliminates many of the aiming variables and limitations associated with other bow sights. In this preferred embodiment the bow sight will accurately and automatically compensate for arrow trajectories of up to a range of 105 feet when shooting from an elevated position of approximately 20 feet above ground level. The bow sight is compact, rugged, and can be aimed quickly in either a precision or instinctive manner. It can also be adjusted quickly to compensate for various ranges when shooting at ground level and accomplishes these tasks without the user having to sight or aim through apertures or other light limiting devices or materials.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description but rather, by the claims appended hereto.

Having described my invention with the particularity set forth above, what is claimed is:

1. A range-compensating archery bow sight for mounting on a bow and aiming and accurately directing arrows to a target when the arrows are shot from the bow, said bow sight comprising a sight body; a front sight mounted on one end of said sight body; a rear sight carrier having a free end and a pivoting end pivotally carried by the opposite end of said sight body; a rear sight mounted on said free end of said rear sight carrier, said free end substantially aligned with said front sight; cam means pivotally mounted in said sight body adjacent to said rear sight carrier, whereby a surface of said cam means abuts said rear sight carrier; a cam positioning weight having one end attached to said cam means, with said one end of said cam positioning weight pivotally mounted in said sight body, whereby said cam positioning weight rotates said cam and said cam pivots said free end of said rear sight carrier responsive to moving said sight body from a horizontal position to a vertical position; and means attached to said sight body for mounting said bow sight on the bow.

2. The range-compensating archery bow sight of claim 1 further comprising an elongated sight body slot formed in said sight body; a threaded stud extending downwardly from said cam positioning weight and through said sight body slot; and a locking thumb nut threaded on said threaded stud for abutting said sight body and selectively locking said cam positioning weight at any desired position along the range of travel of said cam positioning weight through said sight body slot.

3. The range compensating archery bow sight of claim 2 further comprising a cam positioning weight pointer carried by said cam positioning weight and extending downwardly from said cam positioning weight and through said sight body slot, and a calibrated scale located on said sight body adjacent to said cam positioning weight pointer, for referencing the position of said cam positioning weight along the range of travel of said cam positioning weight.

4. The range compensating archery bow sight of claim 1 wherein said mounting means comprises a bow sight mounting bracket for mounting on the bow and on said sight body and further comprising means provided on said bow sight mounting bracket for adjusting the position of said sight body with respect to the bow.

5. The range compensating archery bow sight of claim 4 further comprising an elongated sight body slot formed in said sight body; a threaded stud extending downwardly from said cam positioning weight and through said sight body slot; and a locking thumb nut threaded on said threaded stud for abutting said sight body and selectively locking said cam positioning weight at any desired position along the range of travel of said cam positioning weight through said sight body slot.

6. The range compensating archery bow sight of claim 5 further comprising a cam positioning weight pointer carried by said cam positioning weight and extending downwardly from said cam positioning weight and through said sight body slot, and a calibrated scale located on said sight body adjacent to said cam positioning weight pointer, for referencing the position of said cam positioning weight along the range of travel of said cam positioning weight.

7. The range compensating archery bow sight of claim 1 further comprising an access opening provided in said sight body for accessing said cam and said cam positioning weight and an access cover for removably engaging said sight body and selectively sealing said access opening.

8. The range compensating archery bow sight of claim 7 further comprising an elongated slot formed in said sight body; a threaded stud extending downwardly from said cam positioning weight and through said sight body slot; and a locking thumb nut threaded on said threaded stud for abutting said sight body and selectively locking said cam positioning weight at any desired position along the range of travel of said cam positioning weight through said sight body slot.

9. The range compensating bow sight of claim 8 further comprising a cam positioning weight pointer carried by said cam positioning weight and extending downwardly from said cam positioning weight and through said sight body slot and a calibrated scale located on said sight body adjacent to said cam positioning weight pointer, for referencing the position of said cam positioning weight along the range of travel of said cam positioning weight.

10. The range compensating bow sight of claim 7 wherein said mounting means comprises a bow sight mounting bracket for mounting on the bow and on said sight body and further comprising means provided on said bow sight mounting bracket for adjusting the position of said sight body with respect to the bow.

11. The range compensating bow sight of claim 10 further comprising an elongated slot sight body slot formed in said sight body; a threaded stud extending downwardly from said cam positioning weight and through said sight body slot; and a locking thumb nut threaded on said threaded stud for abutting said sight body and selectively locking said cam positioning weight at any desired position along the range of travel of said cam positioning weight through said sight body slot.

12. The range compensating bow sight of claim 11 further comprising a cam positioning weight pointer carried by said cam positioning weight and extending downwardly from said cam positioning weight and through said slot sight body slot, and a calibrated scale located on said sight body adjacent to said cam positioning weight pointer, for referencing the position of said cam positioning weight along the range of travel of said cam positioning weight.

13. The range compensating bow sight of claim 12 further comprising light-emitting means provided on said front sight for enhancing alignment of said rear sight and said front sight in dim light.

14. The range compensating bow sight of claim 12 further comprising light-emitting means provided on said rear sight for enhancing alignment of said rear sight and said front sight in dim light.

15. The range and elevation compensating bow sight of claim 11 further comprising an access opening provided in said sight body for accessing said cam and said cam positioning weight and an access cover removably carried by said sight body for removably sealing said access cover.

16. The range and elevation compensating bow sight of claim 15 wherein said mounting means comprises a mounting bracket having a mounting hole and first bolt means extending through said mounting hole and threadably engaging the bow for mounting said mounting bracket on the bow; a first mounting slot provided in said bow sight mounting bracket and second bolt means extending through said first mounting slot for mounting said sight body on said mounting bracket and facilitating horizontal adjustment of said sight body; a second mounting slot provided in said sight mounting bracket and third bolt means extending through said second mounting slot for mounting said sight body on said mounting bracket and facilitating vertical adjustment of said sight body; and a third mounting slot provided in said bow sight mounting bracket and fourth bolt means extending through said third mounting slot for mounting said sight body on said mounting bracket and facilitating vertical adjustment of said sight body.

17. A range and elevation compensating bow sight for mounting on a bow and compensating for arrow trajectories of various target ranges and elevations when an arrow is aimed and shot from the bow to a target, said bow sight comprising an elongated sight body having a forward end and a rear end; a front sight mounted on said forward end of said sight body and a rear sight carrier having a free end and a pivoted end pivotally attached to said sight body between said forward end and said rear end, whereby said free end of said rear sight carrier is movable in a circular motion with respect to said sight body; a rear sight mounted on said free end of said rear carrier; a profiled cam pivotally mounted in said sight body adjacent to said rear sight carrier, wherein a surface of said cam abuts said rear sight carrier; and a cam positioning weight attached to said cam and pivotally mounted in said sight body, whereby said cam positioning weight rotates said cam and said cam moves said rear sight carrier responsive to moving said forward end of said sight body from a horizontal position downwardly to a vertical position.

18. The range and elevation compensating bow sight of claim 17 further comprising light-emitting means provided on said front sight for enhancing alignment of said rear sight and said front sight in dim light.

19. The range and elevation compensating bow sight of claim 17 further comprising light-emitting means provided on said rear sight for enhancing alignment of said rear sight and said front sight in dim light.

20. The range and elevation compensating bow sight of claim 17 further comprising an elongated sight body slot formed in said sight body; a threaded stud extending downwardly from said cam positioning weight and through said sight body slot; and a locking thumb nut threaded on said threaded stud for abutting said sight body and selectively locking said cam positioning weight at any position along the range of travel of said cam positioning weight through said sight body slot.

21. The range and elevation compensating bow sight of claim 20 further comprising a cam positioning weight pointer carried by said cam positioning weight and extending downwardly from said cam positioning weight and through said sight body slot, and a calibrated scale located on said sight body adjacent to said cam positioning weight pointer, for referencing the position of said cam positioning weight along the range of travel of said cam positioning weight.

* * * * *